United States Patent [19]

Stumpp et al.

[11] Patent Number: 4,501,252

[45] Date of Patent: Feb. 26, 1985

[54] FUEL INJECTION PUMP

[75] Inventors: Gerhard Stumpp, Stuttgart; Hans-Jörg Vogtmann, Markgröningen; Paul Füssner, Sindelfingen; Manfred Schwarz, Gerlingen; Gerald Höfer, Weissach-Flacht; Karl Konrath, Ludwigsburg-Hoheneck; Max Straubel, Stuttgart; Werner Faupel, Gerlingen, all of Fed. Rep. of Germany

[73] Assignee: Robert Bosch GmbH, Stuttgart, Fed. Rep. of Germany

[21] Appl. No.: 834,638

[22] Filed: Sep. 19, 1977

[30] Foreign Application Priority Data

Sep. 30, 1976 [DE] Fed. Rep. of Germany ..... 2644042

[51] Int. Cl.[3] ..... F02M 59/24

[52] U.S. Cl. ..... 123/502

[58] Field of Search ..... 123/139 AP, 139 AQ, 123/139 ST, 179 G

[56] References Cited

U.S. PATENT DOCUMENTS

| | | | |
|---|---|---|---|
| 2,910,975 | 11/1959 | Evans | 123/139 AQ |
| 3,040,723 | 6/1962 | Scherenberg et al. | 123/139 AP |
| 3,147,746 | 9/1964 | Hofer | 123/139 AQ |
| 3,989,022 | 11/1976 | Pfister | 123/179 G |
| 4,074,667 | 2/1978 | Skinner | 123/139 AQ |
| 4,122,813 | 10/1978 | Barnert et al. | 123/139 AQ |

FOREIGN PATENT DOCUMENTS

| | | | |
|---|---|---|---|
| 2603292 | 8/1976 | Fed. Rep. of Germany | 417/462 |
| 2724159 | 12/1977 | Fed. Rep. of Germany | 417/462 |

*Primary Examiner*—William L. Freeh

*Attorney, Agent, or Firm*—Edwin E. Greigg

[57] ABSTRACT

A fuel injection pump in which the beginning of fuel injection can be adjusted to begin earlier than normal, particularly during warm-up by means of an adjusting piston. The adjustment takes place by changing the tension of the return spring which cooperates with the fuel injection adjustment piston.

2 Claims, 10 Drawing Figures

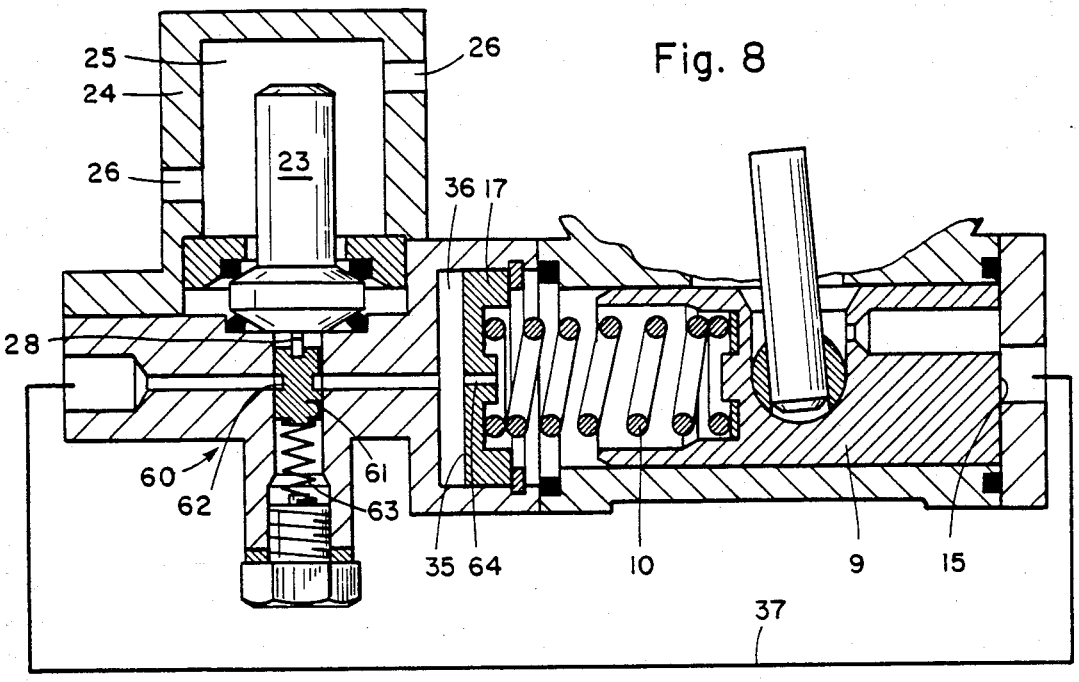
Fig. 8
Fig. 9
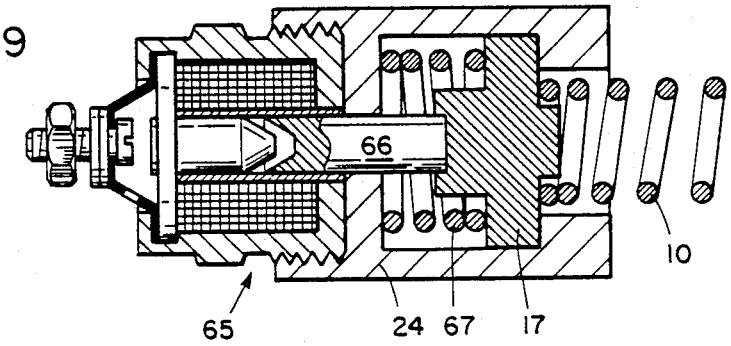
Fig. 10
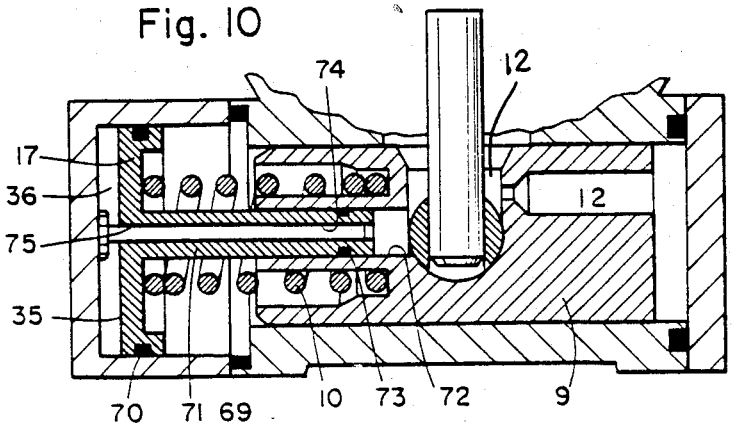

FUEL INJECTION PUMP

BACKGROUND OF THE INVENTION

There is now known a fuel injection pump for a combustion engine having a cam drive arranged to control at least one adjustable pump piston, said cam drive being rotatable relative to associated elements for adjusting the timing of the fuel injection by means of said piston which cooperates with a feed pump to provide an rpm-dependent pressure against the force of at least one resilient member, so that the initial tension of at least one other resilient member can be increased after starting.

The invention relates to a fuel injection pump which can be adjusted to move the timing at the beginning of the injection operation forward and back during warm-up and warm running to provide the best timing of the fuel injection for the temperature of the engine. In a known fuel injection pump of this type an element which raises the spring tension functions to delay the beginning of the injection and is dependent on the rpm. While this known element makes possible an advanced or earlier injection during starting and idling rpm's, the element is moved to a second position after the engine once reaches an rpm that is higher than its idling rpm. An advanced position of such element has the advantage in starting that it provides a quick start, but such a construction also has the disadvantage that once the engine is warm the operation thereof is not only very rough, but is very noisy as well. The temperature of the engine, in conjection with the beginning of the fuel injection process, has a decided effect on characteristics of combustion, such as noise, emission of poisonous gases, and excessive fuel consumption. The known systems are not sufficiently versatile to allow for a modification of temperature at the beginning of the fuel injection with respect to the rpm of an engine.

OBJECT AND SUMMARY OF IHE INVENTION

The principal object of this invention is to provide in a fuel injection pump a primarily rpm-dependent, controlled injection setting, which can also be set at its normal position even at low rpm, as soon as the engine is warm, in order to thereby reduce engine noise, as well as emission of poisonous gases, and excessive fuel consumption.

Another object of the invention is to provide a means by which an overlapping of the technically-determined injection adjustment is coordinated with the temperature-determined injection adjustment. This overlapping can lead from a simple, arbitrary adjustment or correlation to an automatic one. By means of a modular arrangement of elements the degree of automation can be profitably extended.

These and other objects of this invention will be understood and additional advantages thereof will become more apparent from the ensuing detailed description of the preferred embodiments taken in conjection with the drawings.

BRIEF DESCRIPTION OF THE DRAWINGS

Shown are:

FIG. 8 is still another embodiment of this invention using a thermostatic valve;

FIG. 9 is a further embodiment of this invention using an electromagnet; and FIG. 10 is still another embodiment of this invention in which control is achieved by means of a selected throttle aperture.

DESCRIPTION OF THE PREFERRED EMBODIMENTS

Turning now to the drawings, it is known that the injection of fuel in a diesel engine occurs when the engine piston is in the area of its top dead center OT. The moment of the beginning of the injection thereby lies anywhere from before to shortly after OT, depending on the rpm, and generally it is earlier at high rpm's than at lower rpm's. During the time used by the fuel between pump and nozzle, which remains constant for the most part, independent of the rpm, the beginning of the injection is delayed as the rpm increases because of the varying pump feeding speeds and the combustion in the engine. This change of the timing relationship is neutralized by the injection moment adjuster, for which purpose a majority of its work capability is used. The remaining work capability serves, however, depending on the demand from the combustion engine, to improve the fuel consumption, the performance, the motor noise, and/or the exhaust gases. As is known, the delay in combustion of a diesel engine is dependent on temperature, specifically: 1. the fuel temperature and 2. the temperature of the engine, especially the cylinder wall temperature, injection temperature, etc. To neutralize this delay in combustion in cold engines, it is advantageous to advance the beginning of the injection. In warm engines, however, this would lead to a rough operation and in addition the engine would be noisy. To advance injection is also known to be favorable during starting in order to achieve a rapid start of the engine. A further characteristic of a cold engine is, that with an advanced injection, less blue smoke is produced than when the injection is retarded.

According to the present invention, the beginning of the injection in cold engines is therefore advanced over the entire rpm range, and is then retarded after the engine is warm. In the upper rpm range, the known disadvantages of a cold engine, such as resultant blue smoke and noisy operation are less apparent.

Figure 1:
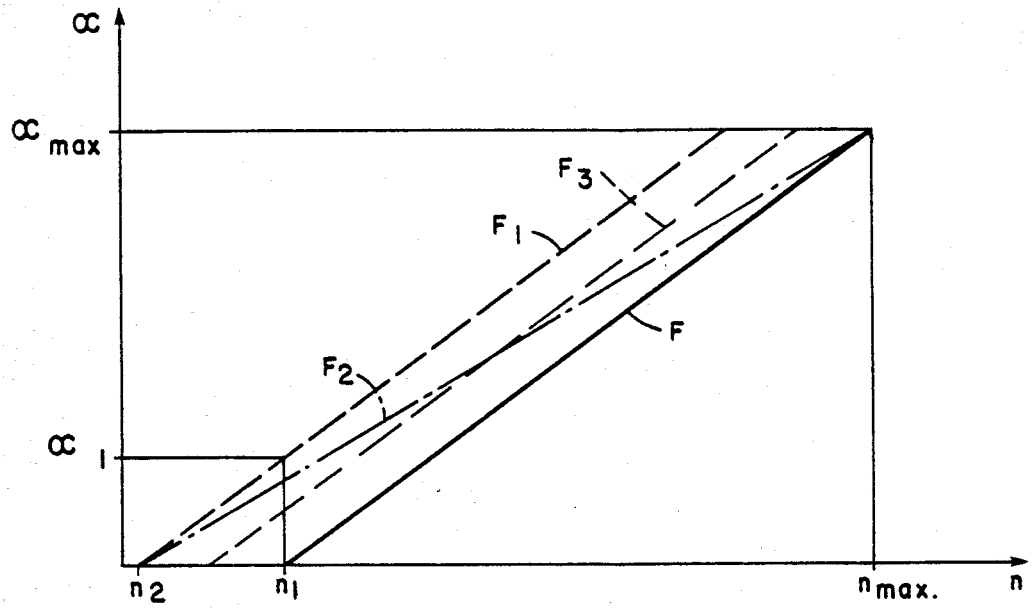
FIG. 1 is a graphic illustration of the degree of the adjustment per rpm.

In the diagram shown in FIG. 1, the injection adjustment angle $\alpha$ is in the ordinate and the rpm n is in the abscissa. By injection adjustment angle is meant the relative rotation between the drive shaft and the piston drive, as described below in more detail. The rpm n is the pump rpm, i.e., the proportional engine rpm. The characteristic curve F corresponds to the injection adjustment during normal operational temperature. According to this characteristic curve F each rpm n corresponds to a certain adjustment angle. The higher the rpm n, the greater is the adjustment angle and the earlier the injection will begin. According to the invention, a shift of the characteristic curve F into the position F1, shown as a broken line, is desirable. With the characteristic curve F1 a certain adjustment occurs even with a corresponding lower rpm, while according to the characteristic curve F a shifting is just beginning at the rpm $n_1$, a shift, $\alpha_1$, towards an "early" on characteristic curve F1 has already occurred. On the characteristic curve F1 a shift would already begin at the rpm $n_2$, namely at an rpm which is far beneath the idling rpm. F1 is achieved by a displacement of the characteristic curve F, for example, by changing the return force of the injection adjuster. F2 shows a changeover between the characteristic curves F and F1, i.e., a gradual decrease of the overlap as the rpm increases, whereby the overlap is controlled depending on the engine temperature. This decrease can also proceed dependent on the rpm with, for example, a device as shown in FIG. 9.

Figure 2:
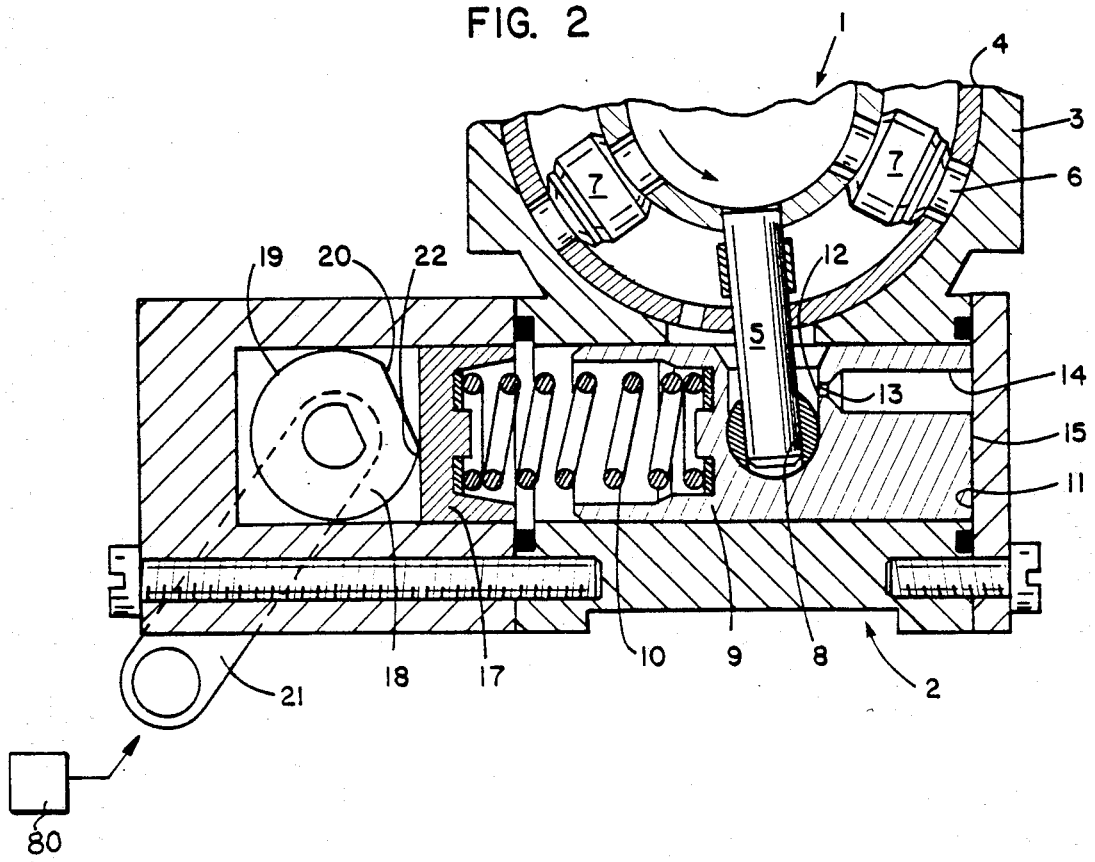
FIG. 2 is the first embodiment of the invention in which adjustment is by means of a cam.

As shown in FIG. 2, an adjustment in a cam drive apparatus 1 of an injection pump not shown in greater detail, occurs by means of an injection adjuster 2. The selected examples concern distributing injection pumps, in which for the most part two types of cam drive devices are used. In the first type the rollers are connected with the pump piston and the cams are arranged on a ring which is guided by the housing. In the other type, as it was chosen here as an example, the rollers are situated on the ring guided by the housing, and the cams are disposed on a cam disc with the pump piston. In each instance the pump piston is driven separately, while the pump rollers and cam work together, whereby depending on the type of drive of the housing-guided ring, the rollers or cams are rotatable relative to each other by means of the injection adjuster 2.

In a housing 3 of the fuel injection pump of the exemplary embodiment of FIG. 2, a roller ring is guided, which is connected with the injection adjuster 2 by an adjusting pin 5. On the roller ring 4 rollers 7 are supported on axles 6, and are shown in a plan view. These rollers cooperate with a front cam plate, which is connected with the pump and distributor piston but not shown. The pump piston and front cam plate thereby rotate in the direction shown by the arrow. The beginning of the feed by the pump piston will occur earlier, i.e., as soon as the roller ring 4 is rotated against the direction of rotation by only a few degrees of an angle. If the amount of injected fuel is determined not by the control of beginning of the fuel feed, but rather by the control of the ending of fuel feed, then this type of shifting also means a change in the beginning of the fuel injected into the engine.

The adjusting pin 5 of the cam drive device engages in a recess 8 of an adjustable piston 9, which can be pushed against the force of a return spring 10 by hydraulic pressure. The further the piston 9 is pushed against the spring 10, the earlier fuel injection will begin. In the shown output position the piston 9 is arranged in abutment against a stop 11. The hydraulic pressure which serves the positioning function is produced in a known manner by a feed pump not shown which is integrated into the housing 3 of the fuel injection pump and which is driven with its rpm. The output pressure of the fuel feed pump is controlled by a pressure control valve, so that it changes proportionally to the rpm, that is, it increases as the rpm goes up and decreases as the rpm goes down.

In the exemplary embodiment, the pump feeds fuel into the housing 3, whereby fuel serves as the pumping medium. The fuel arrives in a pumping space through corresponding supply bores not shown. In addition, fuel flows into a blind bore 12 situated in the adjustable piston 9, into which the adjusting pin 5 also projects. The fuel then flows through a throttling bore 13 and through a bore 14 to the front side 15 of the adjustable piston 9. With a sufficiently high feed pressure, the adjustable piston 9 is then pushed against the force of the spring 10 so that the beginning of the fuel injection can be advanced, as described earlier herein.

A shift of the characteristic curve F to F1 is achieved by changing the pretension of the return spring 10. As soon as the pretension of the spring 10 is lessened, an injection beginning position can start even at small rpm's, for example, at the rpm $n_2$. In this manner it is achieved, that at an adjustment of an idling rpm $n_1$ there is already an adjustment $\alpha_1$ in the early direction. If the spring 10 is then again increased in its pretension, a shifting of the piston 9 does not begin until the rpm $n_1$. By the use of two springs, of which one, for example, is temperature-dependent, a characteristic curve F2 can be attained which will advance the fuel injection beginning relatively more often at lower rpm's than at higher rpm's.

As shown in the drawing of FIG. 2, the spring 10 is supported in a recess in the adjustable piston 9 with the opposite end of the spring received in a spring seat 17, the position of which is variable in order to attain thereby one of the desired characteristic curves F1 to F. In the exemplary embodiment shown in FIG. 2, the shifting of the spring seat 17 occurs by means of a shaft 18, which is arranged to rotate about an axis which is perpendicular to the axis of the spring seat 17. The shaft 18 has a flat section 20 in its generally circular perimetral outer surface 19. Depending on the rotational setting of shaft 18, the spring stop 17 either lies on the circular circumference thereof or in transition against the flat section of the shaft surface. As long as the spring stop 17 lies against the flat section 20, the pretension of the spring 10 is reduced, which corresponds to the characteristic curve F1. The shaft 18 is rotatable by means of a lever 21, which serves as a positioning member for the shaft 18, and on which a control member is attached, which in turn can be in the form of a thermostat, electrical positioning motor or also as some mechanical device 80 (shown schematically in FIG. 2.). By means of the lever 21 the shaft 18 can be rotated to a position in which the spring stop 17 is in contact with the circular surface 19. Thus the spring 10 has its pretension increased so that a shifting of the fuel injection beginning does not occur until the rpm $n_1$ which corresponds to the characteristic curve F. In the Figure, the lever 21 is shown in an in-between position, i.e., the spring stop 17 is no longer lying against the flat area 20, but rather is resting against a transition area 22 between the flat area 20 and the circular area 19. Maintaining such an in-between position corresponds to characteristic curve F3 in FIG. 1. A shift, however, from a low rpm to high rpm of the support of the spring seat 17 on the flat area 20 to the circular area 19 corresponds to the characteristic curve F2. By means of the rotating motion of the lever 21 the overlapping fuel injection beginning adjustment is more or less connected. When the support of the spring seat 17 is on the circular area 19 there is no overlapping present; when the support of the spring seat is on the flat area 20, there is maximum overlapping.

The simplest type of desired partial fuel advance in a cold engine is done mechanically by the driver of the motor vehicle. As soon as the engine then becomes warm, it becomes relatively noisy, so that the driver can move the lever 21 by means of an appropriate device, whereby the overlapping early setting is discontinued and the injection adjuster is consequently retarded. In this manner the operation of the engine of the vehicle becomes substantially quieter. Should the driver neglect to advance his control to an early setting while starting the engine, the first result is that the engine is hard to start, and the second is that, once started, it is relatively noisy. For peak performance of his engine, the operator is thus obliged to set the lever 21 in the appropriate starting warm-up position, and then after warm-up, to set it in the normal position, as described hereinbefore. A mechanical device of this type can be compared with the "shock" of the gasoline engine, whereby for the period from start through warm-up the air-fuel mixture is enriched.

Figure 3:
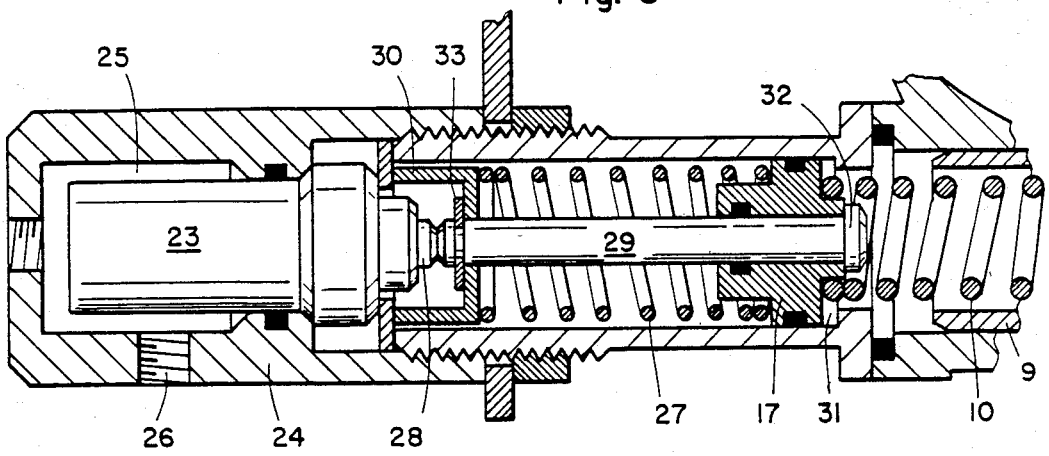
FIGS. 3, 4, 5 and 6 disclose plural embodiments where adjustment is achieved by a spring loaded extensible member.

In the exemplary embodiment shown in FIG. 3 it is further disclosed how the pretension of the injection adjusting spring 10 occurs automatically as engine temperature increases. An extensible element, in this case a thermostatic element 23 positioned in chamber 25 of housing 24 serves for this purpose. This element 23 is subjected to engine coolant which enters chamber 25 through the perforated openings denoted at 26. On the side of the spring seat 17 opposite the spring 10 is a discharge spring 27, which is somewhat stiffer than the return spring 10 of the fuel injection adjusting piston 9, the tension of which is adjustable by means of the thermostat 23. For this purpose, the thermostatic element 23 carries a rod 28 that abuts a guide bolt 29. As soon as the rod 28 extends with increasing temperature, it shifts the spring seat 17 against a stop 31 that is part of the housing by means of the discharge spring 27. By means of this shifting of the spring seat 17, the return spring 10 is correspondingly increased in tension, which leads to a shifting of the characteristic curve from F1 to F. The pretension of the discharge spring 27 is determined by the bolt 29, which supports between its head 32 and a securing ring 33, the spring plate 30 and the spring seat 17. When the spring seat 17 lies against the stop 31 and the temperature continues to rise, the rod 28 continues to extend, thereby compressing the spring 27, without causing any further change of the degree of adjustment of fuel injection.

Figure 4:
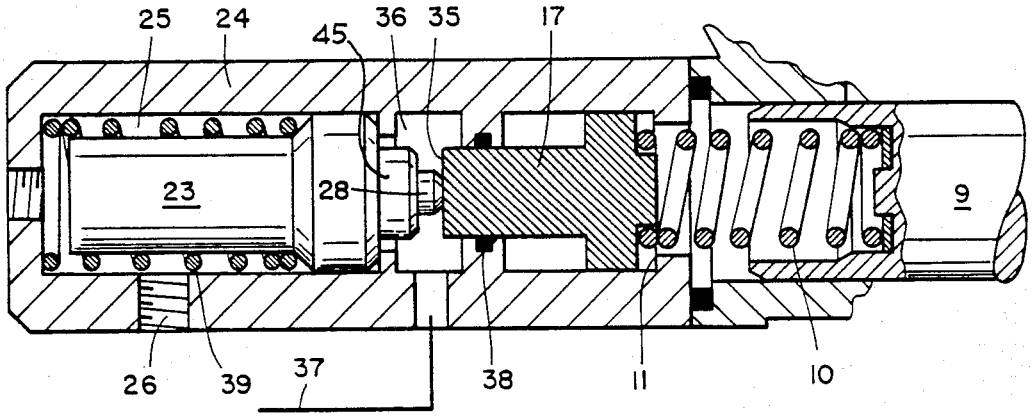

FIG. 4 shows an automatic device that functions for the most part quite similarly to that shown in FIG. 3. Instead of the discharge spring 27, however, the fuel pressure from the fuel pump pushes against the spring seat 17. To this end the spring seat is formed as a stepped or differential piston, one surface 35 of which projects into a space 36, into which fuel is lead under pressure through line 37. In the housing 24 a radial gasket 38 is provided as a sealing means for the piston 17. The area of the one surface 35 is preferably smaller than the front surface 15 (FIG. 1) of the adjusting piston 9. Because of the pressure which prevails in the space 36, the piston 17 experiences a force, which is smaller than the force of the spring 10, so that by this means no shifting of the piston 17 is effected. The piston 17 is not pushed against the spring until the thermostat 23 is sufficiently heated to extend the rod, pushing it against the front surface 35. In this manner, as in the previous example, an increase of the tension of the spring occurs and, thereby, a shifting of characteristic curve F1 to F. If the piston 17 then lies against the stop 11, by further heating of the thermostat 23 it is pushed against a spring 39, which naturally must be stronger than the spring 10. The advantage of the hydraulic support by the fluid pressure on the front surface 35 consists therein that the work capability of the rod 28 is much smaller than when there is no type of supporting apparatus. In this manner a much more exact path control of the rod 28 as to temperature is possible.

Figure 5:
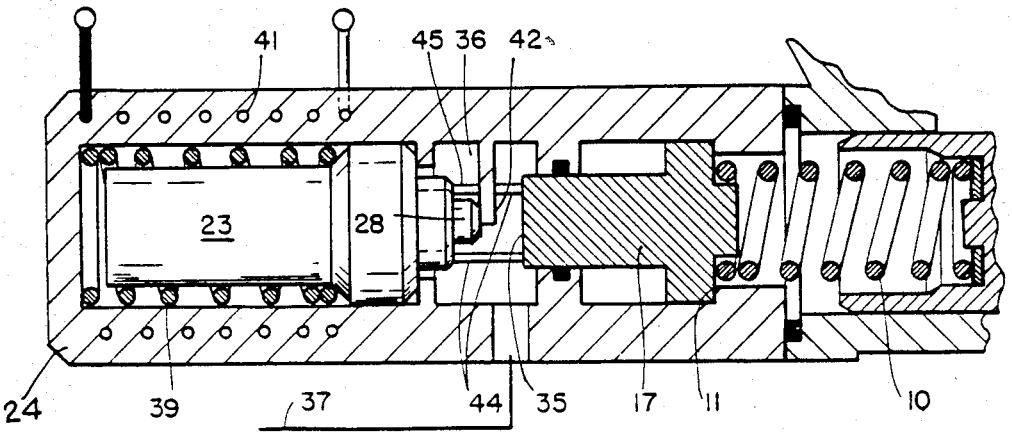

In the exemplary embodiment shown in FIG. 5, which shows a generally similar arrangement to that shown in FIG. 4, the control process of the thermostatic working member 23 is arranged to function in a reverse manner. The thermostatic element is heated along with the diesel engine during the preliminary heating by means of a heating resistor element 41 that is provided in the wall of housing 24 so that the thermostat 23 is pushed against the spring 39 by the rod 28. For this purpose the rod 28 is supported on an inwardly extending integral tang 42 which is formed as a part of the housing. The seat 17 for spring 10, which in FIG. 4 is formed as a piston, is supported between the spring 10 and the housing of the thermostat 23. In FIG. 5 pins 44 serve to correlate the position of elements 23 and 17 and the pins may either be attached on the piston 17 or on the housing of the thermostat 23.

During heating and shifting of the thermostat 23, the piston 17 is also shifted to the left as viewed in FIG. 5 so that the tension of the spring 10 is decreased, which leads to an advancement of the injection beginning at low rpm's (see FIG. 1). As soon as the motor vehicle is started, the heating resistor 41 is shut off (for example by the starting switch), and a cooling of the thermostatic element 23 proceeds accordingly. This cooling function for the thermostat naturally takes substantially longer than the heating, since the surrounding environment is also heated and must cool down. Not until the thermostatic element 23 cools off sufficiently and the rod 28 contracts are the pins 44 pushed by the spring 39 by means of the housing of the thermostat 23, so that the spring seat 17 slides to the right in the drawing against the stop 11. In this position the spring 10 is then increased in tension and corresponds to an injection beginning adjustment according to the characteristic curve F in FIG. 1, for normal operations. The cooling time of the thermostat 23 and the heating time of the engine can be adjusted without further problems. Under certain circumstances the heating process of the heating resistor 41 must be extended according to those circumstances.

In the exemplary embodiment shown in FIG. 4 the front surface 35 of the piston 17 is also acted upon by fuel, which is supplied into the space 36 from the feed pump by means of the line 37. This force acting on the piston 17 supports its adjustment in the direction of the spring 10. Into the space 36 projects, however, also the front side 45 of the thermostat 23, so that the fuel pressure in the space 36 supports the adjustment against the force of the spring 39. In this manner the adjusting forces of the rod 28 can be held to a minimum, which aids in exactness in the overall control.

Figure 6:
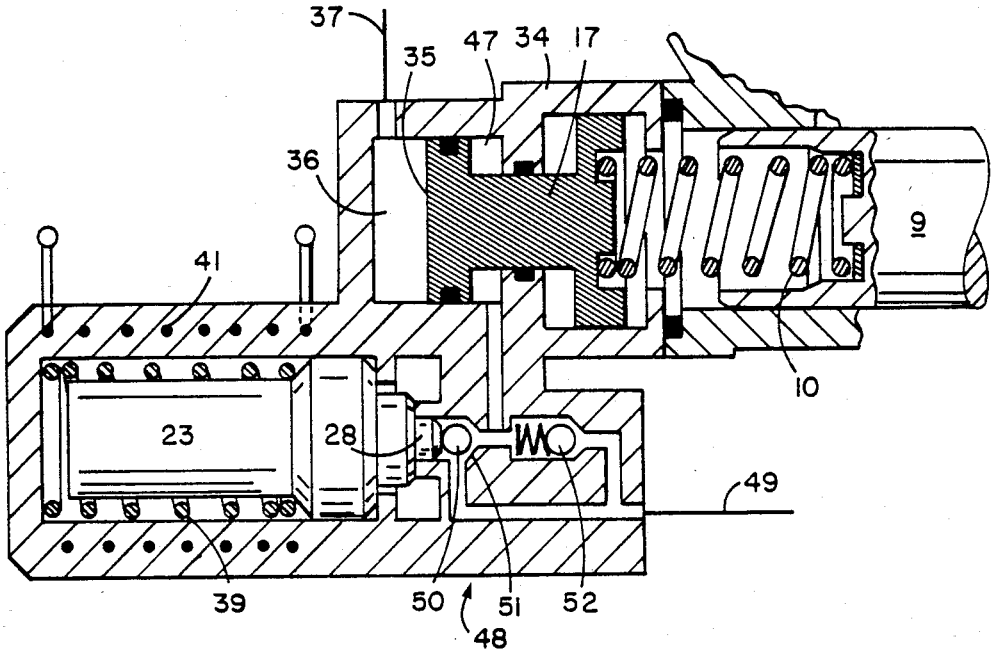

In the exemplary embodiment shown in FIG. 6 a desired setting of the spring seat 17 is blockable by means of the thermostatic control member. The spring seat 17 is formed as a stepped or differential piston, which with its two steps and the housing 34 defines a space 47. The front surface 35 of piston 17 is furthermore acted upon by the fuel pressurized by the feed pump. This fuel is led through the line 37 into the space 36. The front suface 35 must be large enough in this regard, that it makes possible a shifting of the spring 10 when acted upon by the feed pump pressure. For this purpose it must be larger than the front surface 15 of the injection adjustment piston 9, which is not shown in FIG. 6. The thermostat 23 controls a valve 48, which is arranged in a line 49, that leads to the space 47, and which is connected to a source of low pressure.

As shown in FIG. 6, as soon as the rod 28 of the thermostat 23 has contracted, the connection is open and the piston 17 can be pushed against the spring 10, thereby increasing its its tension. The thermostat 23 is heated, as in the embodiment of FIG. 5, by an electric resistor 41 during the preheating of the engine. In this manner the valve 48 closes when a ball valve 50 is pressed against a valve seat 51. After the valve is closed, the entire thermostat 23 can be pushed against the spring 39, in order to make possible a further extension of the rod 28. As soon as the valve 48 is closed, however, the piston 17 cannot be shifted during starting of the engine and build-up of a feed pump pressure, because the space 47 is blocked. As soon as the valve 48 opens after cooling of the thermostat 23, the fuel flows out of the space 47 through the line 49, and the piston 17 is shifted to increase the tension of the spring 10. In the valve 48 there is an additional return valve 52 provided, in order to fill the space 47 with fuel by means of the low feed pressure during non-use of the motor vehicle. This return valve 52 also makes possible a filling of the space 47 as long as the valve 48 is closed because of the heating, and the piston 17 is loaded towards the left by the spring 10. A situation can arise, where after the engine is turned off, the piston 17 assumes a position corresponding to a late adjustment (moved towards the right) and cannot be moved to the left until the feed pump pressure is built up. Since the pre-feed pump, which produces the pressure in the line 49, is running even during preheating for the new start, this supply pump can fill the space 47 by means of the valve 52 before the feed pump supplies a pressure in the space 36, even if, because, of the preheating the ball valve 50 is already against the valve seat 51. Thus, as soon as the thermostat 23 cools after the heating element is shut off, it will return to its original position, driven by the spring 10, before the ball valve 50 lifts away from the seat 51 for a further contraction of the rod 28. This period of time must be synchronized with the time period for the warming of the engine. Even when the ball valve begins to lift away from the seat 51, at first only a throttling section is opened, which then makes possible a slow shifting of the piston 17 in the direction of the spring 10. One does not suddenly arrive, then, from the characteristic curve F1 to the characteristic curve F, but rather passes through the characteristic curve F2, that is, a number of characteristic curves F3, before arriving at curve F.

Figure 7:
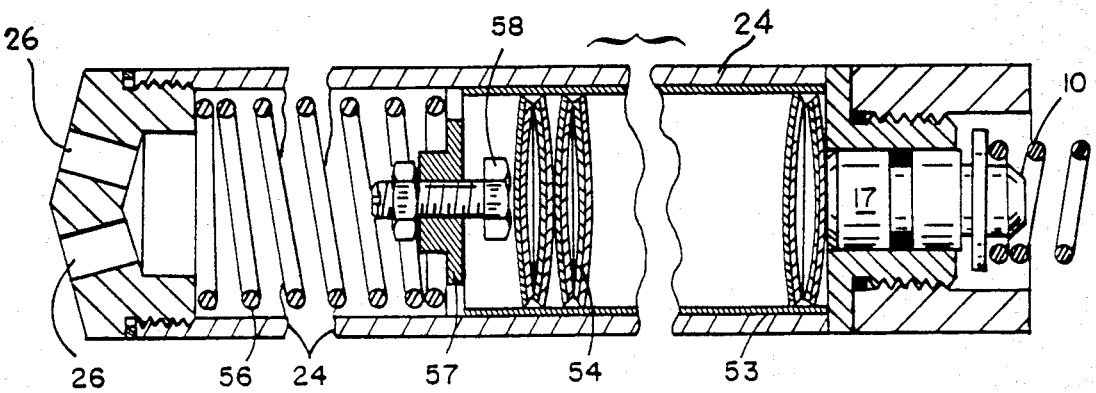
FIG. 7 is another embodiment of the invention which utilizes bimetallic discs.

The exemplary embodiment shown in FIG. 7 works in principle generally in the same manner as the embodiment shown in FIG. 3. Instead of a thermostatic element, there is illustrated a cylinder 53 that is provided with bimetallic discs 54. The cylinder 53 is situated in the housing 24 and coolant, which is led in and out through the apertures 26, circulates around it. It is to be understood that these bimetallic discs 54 will buckle as the temperature increases. In the cylinder 53 are disposed a number of these kinds of bimetallic discs 54, which are thus arranged to act in unison on the spring seat 17 of the spring 10. Because the bimetallic discs 54 can buckle beyond the desired range, and thereby effect an extension of the desired path, a spring 56 serves as a neutralizer. This spring 56 functions together with the bimetallic discs 54 via a spring plate 57 interposed therebetween and takes up the excess travel. For controlling the basic setting of the device an adjusting screw 58 is situated in an aperture in the spring plate 57. In the drawing the bimetallic discs 54 are shown in a warm condition, that is, the spring 10 is pretensed and, accordingly, the injection adjuster is set in its late position.

Another arrangement with bimetallic discs is conceivable, in which the bimetallic discs even out as the temperature increases, that is, they are buckled the most in their cold condition, whereby then, similarly as in the FIG. 5 and 6, a heating of the bimetallic discs occurs before starting, whereby the spring 10 has its tension decreased. After starting the engine these bimetallic discs then cool off, at which time they begin to buckle and push the piston 17 into the position shown and in this manner the spring 10 is again increased in tension.

In the exemplary embodiment shown in FIG. 8, as in the one shown in FIG. 6, by means of the front side 35 of the piston 17, the spring 10 is acted upon by fuel under pressure from the feed pump. In order to maintain a setting of the piston 17 independent of the adjusting piston 9, the front surface 35 is cf greater area than the front surface 15 of the adjusting piston 9. The line 37 containing the fuel that is pressurized by the feed pump goes through a thermostat valve 60 before it empties into the space 36. This thermostat valve contains a thermostatic element 23 that includes a rod 28 that is arranged to activate the valve member 61, so that when the rod 28 extends outwardly an annular groove 62 provided on the valve member 61 opens the line 37. As shown in the drawing of FIG. 8 the valve member 61 is pushed toward the thermostatic element 23 by the force of a spring 63. The thermostatic element 23, furthermore, is situated in a housing 24 the inner space 25 of which is arranged to have coolant flow therethrough with the coolant entering and exiting through apertures 26. When the engine is cold, the piston 17 which is shifted by the spring 10, takes an output position in the direction of the valve 60. In this position, the tension of the spring 10 is decreased, which corresponds to an earlier setting along the lines of characteristic curve F1. After the engine has been warmed up as soon as the line 37 is opened and the piston 17 is pushed in the direction of the spring 10, the spring 10 is increased in tension, which corresponds to a later setting along the lines of characteristic curve F. Because here, too, the valve member 61 is gradually moved, intermediate settings of the piston 17 result, corresponding to the throttling effect. In order to guarantee a small yet constant fuel flow through the line 37 when the thermostat valve 60 is open, an axially disposed throttle bore 64 is provided in the piston 17. This throttle bore connects the space 36 with the pressure reducing space in which is positioned the spring 10.

Instead of a thermostatic element being used as explained a magnet can also serve to drive the valve member 61. In such a construction when the engine is shut off the line 37 would again be closed before the piston 17 had reached its original position. By means of the throttle bore 64 the piston 17 can still slide to its original position, in order to make possible the desired early setting when the engine is next started.

FIG. 9 discloses a still further embodiment of the invention in which there is shown an additional concept for changing the tension of the spring 10.

By means of an electromagnet 65, which is threaded into the housing 24, the spring seat 17 can be pushed against the force of the spring 10. The armature 66 of the magnetic valve functions together with the spring seat 17 for this purpose. To partly neutralize the forces, a spring 67 engages the side of the spring seat 17 that is away from the spring 10. The spring 67 is supported on its other end against the housing 24. There are at least as many possibilities for engagement and control that are conceivable with this arrangement, as there were with the last exemplary embodiment. In this illustrated embodiment the armature 66 is firmly connected with the spring seat 17 and the magnet 65 is turned on during starting, thereby pushing the spring seat 17 against the spring 67. In this way tension of the spring 10 is reduced in the desired manner. As soon as the engine has warmed up, the magnet is turned off, the armature is released, and the spring 67 pushes the spring seat 17 against the spring 10, so that its tension then corresponds to the characteristic curve F in FIG. 1. Another possible embodiment is also conceivable, i.e., where the magnet is arranged to function in a reverse direction, so that the magnet is not turned on until after the warm-up, in order to push the spring seat 17 against the spring 10. Naturally, for this purpose the spring 67 would have to be weaker than the spring 10, in contrast to the previous embodiment of the invention described. There is a distinct advantage in that during normal operation such a construction since even if the magnet were to fail the engine still would be easy to start.

In the last exemplary embodiment of this invention shown in FIG. 10, a piston 17 is used to change the tension of the spring 10, as in FIG. 8. The piston 17 has a greater diameter than the adjusting piston 9, and is movable by means of its front surface 35 being acted upon by the pressure of the fuel introduced thereto from the fuel pump.

The piston 17 is provided with an annular groove, as shown, with this groove arranged to receive an annular gasket 70 thereby forming a seal with the cylinder 69 and providing chamber 36 spaced from the space containing spring 10. On the front side of the piston 17 a cylindrical section 71 with a small diameter is arranged, which is guided into a bore 72 of the adjusting piston 9, and which has a gasket 73 between itself and this piston 9. The longitudinal bore 72, on the other hand, is connected inside the adjusting piston 9 to the blind bore 12 (FIG. 2) in which the pressure from the feed pump prevails. A bore 74 leads through the piston 17 and the cylindrical section 71 and the bore 74 connects the space 36 with the bore 72 and thereby the blind bore 12.

The bore 74 is formed as a throttle bore so that after the engine is started the piston 17 is very slowly pushed against the spring 10, according to the throttle effect in the bore 74, which corresponds to the characteristic curve F2. The throttle bore must be relatively small, since the adjusting time must correspond to the warm-up time of the engine. When the engine is non-operational and thus cooling down, the piston 17 slides gradually back into its original position. In order to be able to calibrate this throttling, a headed shaft 75 is arranged in the bore 74, which is attached to the front wall of the space 36. By means of the movement of shaft 75 relative to piston 17, a blocking of the throttle bore opening is avoided.

The fuel pressurized by the feed pump can of course also be led from the outside into the space 36, at which time the shaft is then advantageously attached to the piston and arranged to project into the feed bore. Also, instead of a piston which serves to change the tension of the spring 10, a supplementary piston of smaller diameter arranged inside the adjusting piston could be used. This supplementary piston would be loaded by a supplementary spring. The space defined by the adjusting piston bore and supplementary piston would then remain in a throttled connection with the feed pump pressure, so that by shifting the supplementary piston a total shift towards retarding the injection would occur.

As can be seen from the many embodiments of the invention disclosed herein, every possible combination of individual adjusting and control members is conceivable, to achieve a relatively stronger shift towards an earlier fuel injection in a cold engine than in a warm one.

The foregoing relates to preferred exemplary embodiments of the invention, it being understood that other embodiments and variants thereof are possible within the spirit and scope of the invention, the latter being defined by the appended claims.

What is claimed is:

1. In a fuel injection pump for an internal combustion engine including: a housing; at least one pump piston in said housing; a cam drive arranged in the housing to produce the fuel feeding stroke of the at least one pump piston; at least one return spring; and an adjustable piston connected at one end to the at least one return spring and to the cam drive, said cam drive including a rotatable part, with said cam drive being rotatable relative to the direction of rotation of the rotatable part for adjusting the timing of the beginning of the fuel injection by means of the adjustable piston which is acted upon by an rpm dependent pressure produced by a feed pump against the force of the at least one return spring so that the tension of the at least one return spring can be varied after starting as a function of said rpm dependent pressure, the improvement comprising:

(a) a spring seat engaging the other end of the at least one return spring;

(b) adjusting means connected to the spring seat; and;

(c) control means connected to the adjusting means, whereby the spring seat is shifted by the control means acting through rotation of the adjusting means to change the initial tension of the at least one return spring at the earliest during engine warm-up and said adjusting means comprises a shaft having a longitudinal axis extending transversely to the direction of shifting of the spring seat, with said shaft having at least one roller cam means arranged eccentrically with respect to the longitudinal axis of the shaft and engageable with the spring seat, and wherein the spring seat is shifted by the roller cam means during rotation of said shaft.

2. The fuel injection pump as defined in claim 1, wherein the roller cam means includes a flat section.

* * * * *